US006056151A

United States Patent [19]

Peery et al.

[11] Patent Number: 6,056,151

[45] Date of Patent: May 2, 2000

[54] GUMBALL MACHINE

[75] Inventors: Daniel C. Peery; Gregory M. Peery, both of Orem, Utah

[73] Assignee: Gizmo Distributing, Inc., Beloit, Wis.

[21] Appl. No.: 09/034,709

[22] Filed: Mar. 4, 1998

[51] Int. Cl.[7] ..... G07F 11/00

[52] U.S. Cl. ..... 221/24; 221/155; 221/196; 221/312 R; 221/265; 221/252

[58] Field of Search ..... 221/24, 155, 196, 221/195, 312 R, 265, 252; 463/67, 69

[56] References Cited

U.S. PATENT DOCUMENTS

| | | | |
|---|---|---|---|
| 869,807 | 10/1907 | Rosenfeld | 221/155 |
| 1,358,044 | 11/1920 | Williams | 221/252 |
| 2,880,906 | 4/1959 | Probasco | 221/312 R |
| 4,334,635 | 6/1982 | Grab . | |
| 4,560,086 | 12/1985 | Stol . | |
| 4,667,848 | 5/1987 | Gold . | |
| 5,004,122 | 4/1991 | Poynter . | |
| 5,176,290 | 1/1993 | Schwarzli . | |
| 5,452,822 | 9/1995 | Haymond . | |
| 5,509,522 | 4/1996 | Laidlaw | 221/196 |
| 5,765,606 | 6/1998 | Takemasa et al. | 221/252 |
| 5,782,378 | 7/1998 | Hart et al. | 221/24 |
| 5,788,115 | 8/1998 | Halliburton | 221/155 |
| 5,833,117 | 11/1998 | Kovens et al. | 221/24 |
| 5,897,022 | 4/1999 | Mann | 221/24 |

*Primary Examiner*—H. Grant Skaggs
*Attorney, Agent, or Firm*—Thorpe, North & Western, LLP

[57] ABSTRACT

A bulk vending amusement device has multiple, visible tracks extending from a bin for moving a product to a dispenser for dispensing the product to entertain a user. A diverter, disposed between the bin and the multiple tracks, diverts the product from the bin to one of the tracks so that a user is unable to ascertain which of the multiple tracks will dispense the product. The diverter has a plurality of chutes disposed on a rotating plate each under a plurality of holes. The plate incrementally rotates, sequentially disposing each chute under a hole in the bin. Each chute is configured and oriented to divert the product to a different track as it is located under the bin by the rotating disk.

17 Claims, 4 Drawing Sheets

GUMBALL MACHINE

BACKGROUND OF THE INVENTION

1. Field of the Invention

The present invention relates to a bulk vending amusement apparatus, particularly well suited for use with gumballs and the like, for dispensing a product in an entertaining manner. More particularly, the present invention relates to a bulk vending apparatus having a diverter to divert the product to one of a plurality of visible tracks which each define a different movement path between a product bin and a dispensing point.

2. Prior Art

Bulk vendors are well known in the art and include a product reservoir, a coin actuated dispensing mechanism, and a dispensing point from which the product is removed. Simple devices, such as gumball machines, are designed to serially dispense the product from the reservoir. These vending devices are typically designed only to display and dispense the product. Such devices are typically limited by their inability to attract potential customers. Attempts have been made to overcome this drawback and draw attention to the devices. One such improvement has been to paint the devices bright colors and configure the machines in a more appealing manner. Another improvement has been to provide limited entertainment in addition to dispensing the product. For example, U.S. Pat. No. 5,452,822, issued Sep. 26, 1995 to Haymond discloses an elevated machine with a product reservoir disposed at a substantial height and a dispensing point disposed near the base or ground. A helical track is formed in a transparent column extending between the reservoir and base. Thus, when the device is actuated, the product, such as a gumball, winds its way from the reservoir to the dispensing point through the visible, helical track. The track configuration provides a limited degree of entertainment while the size of the device draws attention. Other machines have been designed with more sophisticated and visually stimulating dispensing tracks. These devices typically have a display case disposed between the reservoir and the dispensing point in which a complicated track configuration is contained. These devices also incorporate light and sound to entertain and attract attention. While largely successful, these devices are still limited by the single track. After a single product has been dispensed, the device loses its novelty and appeal. In addition, more sophisticated consumers are able to quickly ascertain the path of the product along the track and become disinterested.

Therefore, it would be advantageous to develop a bulk vendor capable of providing multiple and unexpected entertainment. It would also be advantageous to develop a bulk vendor for repeatedly encouraging activation. In addition, it would be advantageous to develop a bulk vendor for drawing attention of potential customers.

OBJECTS AND SUMMARY OF THE INVENTION

It is an object of the present invention to provide a bulk vendor that provides multiple and unexpected entertainment.

It is another object of the present invention to provide a bulk vendor that encourages repeated activation.

It is yet another object of the present invention to provide a bulk vendor that draws attention.

These and other objects and advantages of the present invention are realized in a bulk vending amusement device having a plurality of visible tracks and a diverter for diverting a product down one of the tracks.

The device has a coin operated crank mechanism for receiving coins and activating the device. The device has a bin for holding the product, such as gumballs, and a dispenser for dispensing the product. The device also has a hopper disposed under the bin for separating the product into individual units and for incrementally and sequentially releasing each individual product from the bin.

In accordance with one aspect of the present invention, a plurality of tracks extend between the bin or hopper and the dispenser. Each track defines a different movement path from the bin or hopper to the dispenser. The tracks are visibly disposed in the device and configured in various ways to provide entertainment as the product makes its way from the bin to the dispenser. Therefore, the device provides multiple entertainment events and prompts multiple uses from a single person. In addition, the tracks appeal to more mature individuals, as well as children, thus increasing the potential customer base.

In accordance with another aspect of the present invention, a diverter is disposed between the bin or hopper and the tracks for diverting the product into one of the tracks. The diverter has a plurality of chutes disposed on a rotatable plate. The plate has a plurality of holes located above each chute. As the plate incrementally rotates, each chute is sequentially located under a point where the hopper or bin releases the product.

The diverter may be hiddenly disposed in the device so that the user does not know which track or path the product will follow. Therefore, the device provides an element of surprise or an unknown aspect. Alternatively, the diverter may be visibly disposed along with the track as it is still difficult to ascertain which track will line up with the chute.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
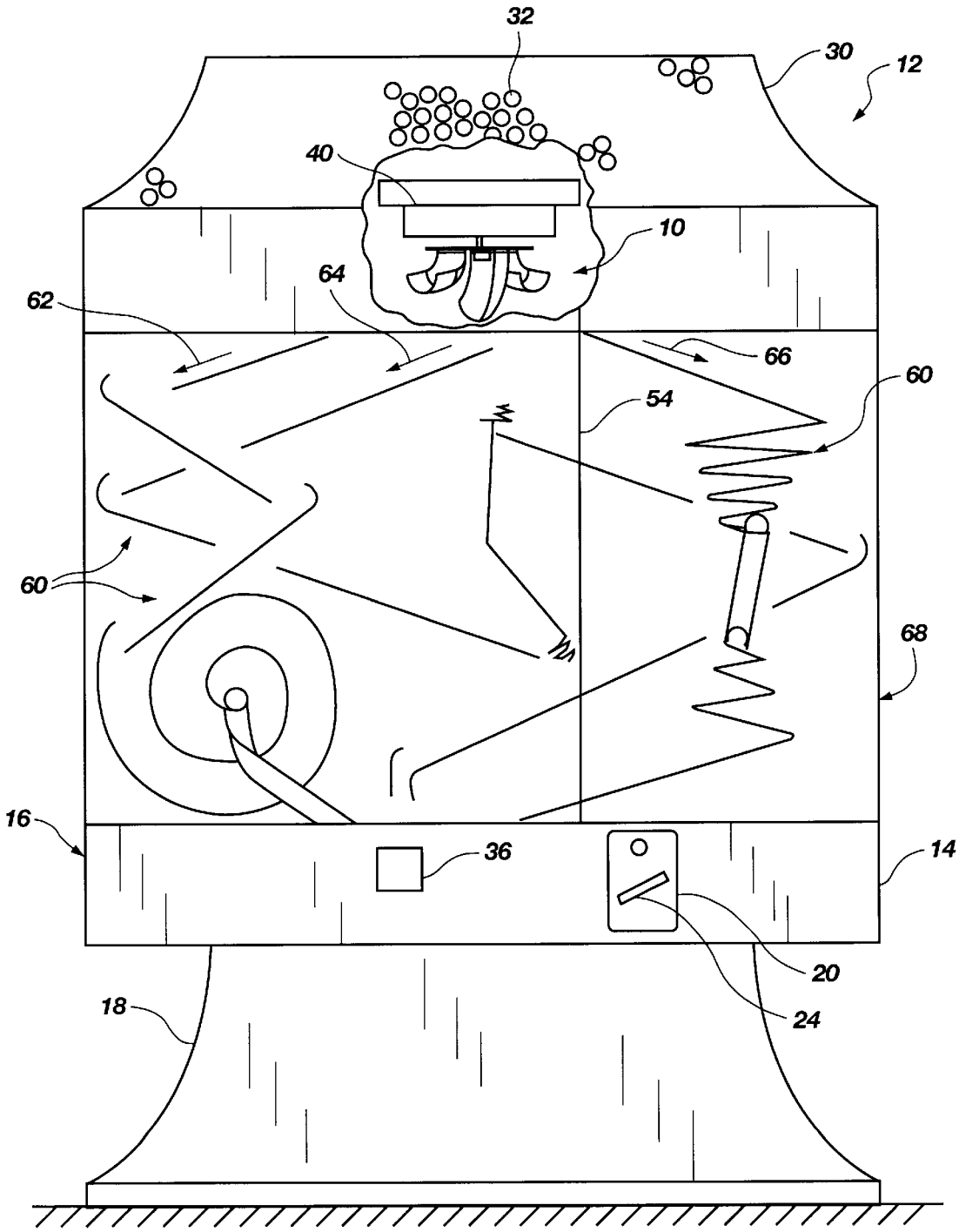
FIG. 1 is a front view of a bulk vending apparatus with a cut away portion showing a preferred embodiment of a diverter of the present invention.

As illustrated in FIG. 1, a preferred embodiment of a diverter, indicated generally at 10, of the present invention is shown with a bulk vending amusement device, indicated generally at 12. The device 12 has a frame or base member 14 disposed on the ground. The frame or base 14 has a vending portion 16 disposed on a pedestal portion 18. It is of course understood that the configuration of the frame or base 14 is not critical to the practice of the present invention. The pedestal portion 18 may be omitted by disposing the vending portion 16 on a counter or other display device. In addition, the vending portion 16 and pedestal portion 18 may be formed integrally or attached to give the appearance of a single unit for aesthetic reasons. The vending portion IG and pedestal portion 18 may also have various configurations for aesthetic reasons. The device 12 is preferably configured to draw attention, such as by presenting an appealing look and using bright colors.

The device 12 has a coin operated crank mechanism 20, which is well known in the art. The crank mechanism 20 is conveniently located on the base 14. The mechanism 20 accepts a coin, or combination of coins, through an aperture disposed on its face. Turning a crank 24 with the coins so deposited, activates the device 12. The crank may mechanically operate the components of the device, using the physical energy of the user to power the device, or may simply trigger electrical and/or mechanical components, using an external power source, such as electricity, to power the device. The coins are collected in a secured receptacle within the device and are later retrieved. Alternatively, the mechanism 20 may accept tokens in a similar manner. The mechanism may also accept other forms of currency or credit. For example, the mechanism 20 may have an electronic reader for reading information stored in magnetic strips on plastic cards, such as credit, debit, or pre-paid cards. Furthermore, the mechanism 20 may accept payment and activate automatically, without the need for turning a crank.

The device 12 has a product bin 30 disposed on the base 14 for holding a product 32. The bin 30 is preferably transparent, or has a transparent portion, for displaying the product 32. The bin 30 may be configured with unique shapes as desired for creatively displaying the product 32 and attracting attention. For example, the bin 32 may be simply rectangular, or may be shaped to conform to part of a theme consistent with the device 12. In addition, the bin 30 is preferably located at the top of the device 12 or on top of the base 14 so that the device 12 may take advantage of gravity in its operation. Alternatively, the bin 32 may be otherwise located as desired and supported with a separate power source. The product 32 may be any product traditionally dispensed through such devices or any similar product, such as gum balls, candy, mints, toys, etc.

The device 12 has a dispenser 36 conveniently located and disposed in the base 14 for dispensing or presenting the product to the user. The dispenser 36 receives the product from the device before it is retrieved by the user. The dispenser 36 may be configured as a cup, dish, drawer or other container and may have a lid or flap. In addition, the dispenser 36 is preferably located near the bottom of the device 12 or base 14, or at least below the bin 32 so that the device 12 may take advantage of gravity in its operation.

Figure 3:
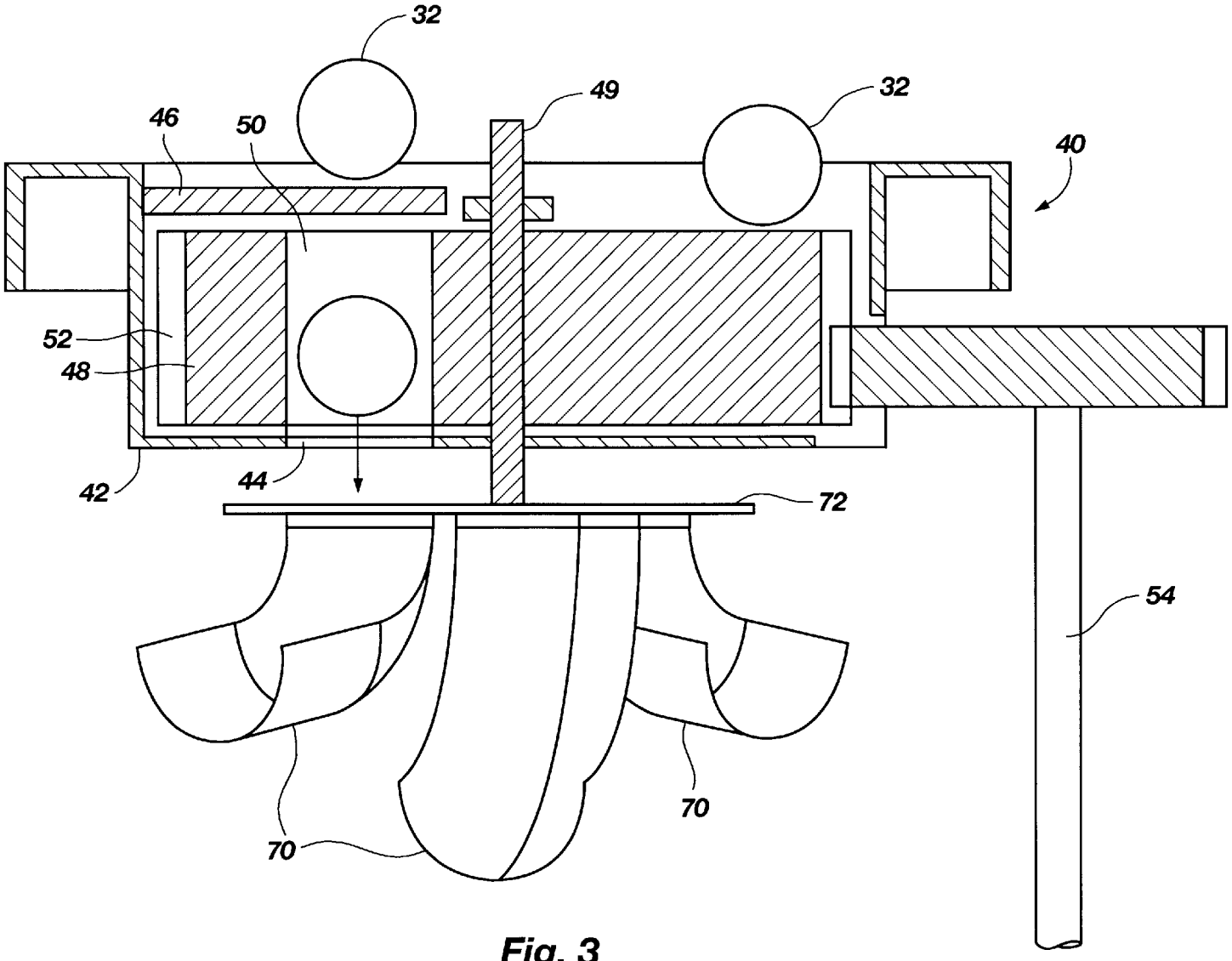
FIG. 3 is a cross section view of a preferred embodiment of the diverter of the present invention taken along line 3—3 of FIG. 2.

The device 12 has a hopper 40 and is well known in the art. The hopper 40 is disposed in the base 14 under the bin 30. Referring to FIG. 3, the hopper 40 has a base plate 42 with an aperture 44 through which the product 32 passes to be dispensed. The hopper 40 has an upper plate 46 disposed above the aperture 44 for preventing the product 32 from passing directly from the bin 32 through the aperture 44. A rotatable disk 48 is disposed between the upper and lower plates 46 and 42. The rotatable disk is disposed on a shaft 49 and rotates about the shaft.

The rotatable disk 48 has a plurality of holes 50 formed therein. The holes 50 are sized and configured for receiving individual units of the product 32. The holes 50 are spaced apart from one another and from the shaft 49. The holes 50 sequentially align with the aperture 44 in the lower plate 42 as the disk 48 is incrementally turned.

A plurality of teeth 52 are formed about the periphery of the disk 48. The crank mechanism 20 operatively engages the teeth 52 so that as the crank 24 is turned, the disk 48 is rotated incrementally, sequentially locating the holes 50 with the aperture 44. The turning motion of the crank 24 may be transferred from the crank mechanism 20 to the hopper 40 by a shaft 54, as shown in FIGS. 1 and 3. In operation, the product 32, located above the hopper 40, rests on the upper plate 46 and disk 48. Some of the product 32 falls into the holes 50 and rests on the lower plate 42, but is prevented from passing directly out of the bin 30, through a hole 50, and through the aperture 44 by the upper plate 46.

When a coin is deposited and the crank turned, as described above, the crank turns the disk 48 causing one of the holes 50, containing product 32, to align with the aperture 44. The product passes through the aperture 44 to be dispensed. As indicated above, the disk 48 may be turned mechanically, using force supplied by the user, or may be turned automatically by an electric motor or the like.

Referring again to FIG. 1, the device 12 advantageously has a plurality of tracks, three of which are shown and indicated generally at 60. The tracks 60 are disposed in the base 14 and extend between the bin 30 or hopper 40 and the dispenser 36. Each track 60 defines a different movement path, three of which are shown and indicated by arrows at 62, 64, and 66, from the hopper 40 or bin 30 to the dispenser 36. The base 14 preferably has a display section or transparent portion, indicated at 68, through which the tracks 60, or a portion thereof, are visible from outside the device 12. Thus, the tracks 60 are visibly disposed in the device 12.

The tracks 60, creating the several different movement paths 62–66, are configured to entertain the user. Thus, the tracks 60 form loops, spirals, curves and twists. The tracks 60 need not be configured as continuous channels, but may include free falls, stairs, ramps, funnels, etc. The tracks 60 take advantage of gravity to drive the product along the tracks. In addition, other devices may be disposed in the display section 68 and interacting with the tracks 60. For example, motorized belts may be used to elevate the product. As another example, baskets disposed on pivoting arms may be used to transport the product. The tracks 60 illustrated in FIG. 1 are only representations of the various configurations possible and are intended only to indicate the entertainment value of multiple tracks.

The plurality of tracks 60 of the present invention represents a significant improvement over prior art devices utilizing a single track. The value of an amusement bulk vending device is its ability to attract customers by providing entertainment as well as a product. Thus, customers not only patronize the device to obtain a product, such as a gumball, but also to be entertained. A premium may be charged for this added feature. Thus, people are often willing to pay much more for the gumball dispensed in an entertaining fashion, than a gumball dispensed in the traditional manner. In addition, traditional bulk vending devices typically appeal only to young children interested in candy. These traditional devices rarely appeal to older people. The amusement devices appeal not only to young children who are fascinated by the activity, but to more mature people as well, who are interested in seeing the device work. Once the device is experienced, however, mature people rarely return to the device because they have already seen it work and are no longer interested. With multiple paths, however, the device must be experienced multiple times. Typically, a user will be unaware of which track will be selected upon initial use of any given time. Accordingly, the present device offers the novelty of surprise. This aspect is discussed in greater detail hereafter. Thus, even more mature people desire to see the device work again in order to receive the new experience provided by a different track or path. Therefore, not only is the device able to demand a premium for the entertainment, but to attract multiple use because of the different performances provided by multiple tracks.

Figure 2:
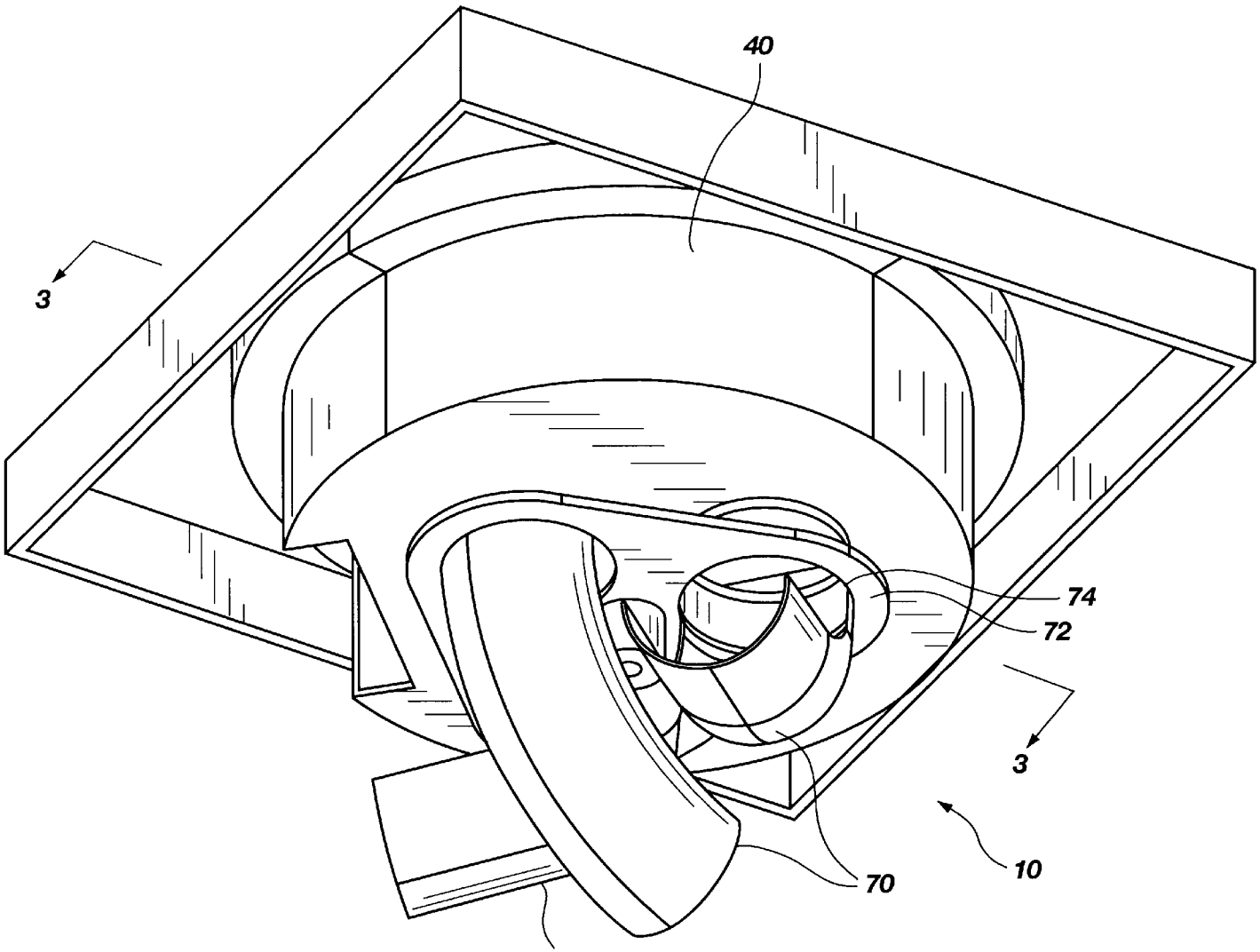
FIG. 2 is a perspective view a preferred embodiment of the diverter of the present invention.

The device 12 also advantageously has a diverter 10 disposed in the base 14 between the hopper 40 or bin 30 and the plurality of tracks 60. Referring to FIGS. 2 and 3, the diverter 10 has a plurality of chutes, indicated generally at 70. The chutes 70 are attached to a rotatable plate 72, each under an aperture 74 formed in the plate 72, as shown in FIG. 2. The plate 72 is attached to the shaft 49 of the hopper 40, as shown in FIG. 3. Thus, the plate 72 and chutes 70 rotate with the disk 48 of the hopper 40. The apertures 74 in the plate 72 and the chutes 70 align with the holes 50 in the disk 48. Thus, when the hole 50 in the disk 48 aligns with the aperture 44 in the lower plate 42 of the hopper 40, the product 32 passes through the aperture 44 in the lower plate 42 and the aperture 74 in the plate 72 of the diverter 10 and into one of the chutes 70, as shown in FIG. 3.

Figure 4C:
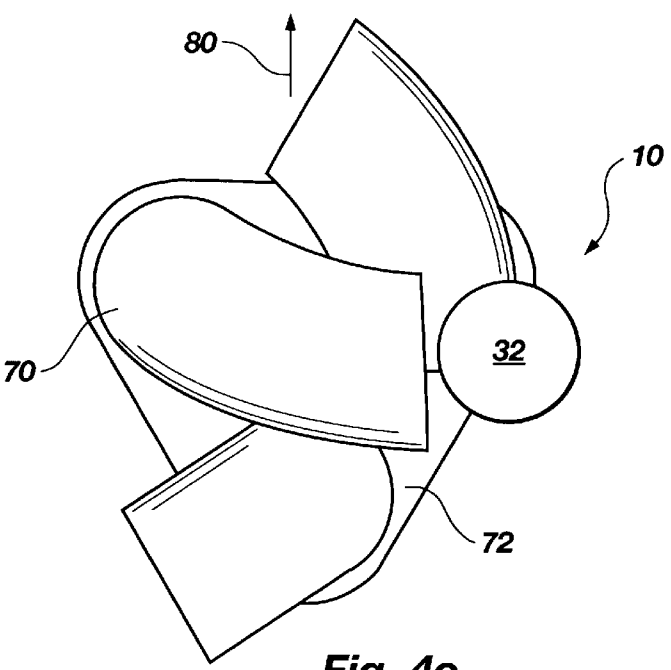
FIGS. 4*a–c* are bottom views of a preferred embodiment of the diverter of the present invention showing the location of the product as the diverter rotates.
Figure 4B:
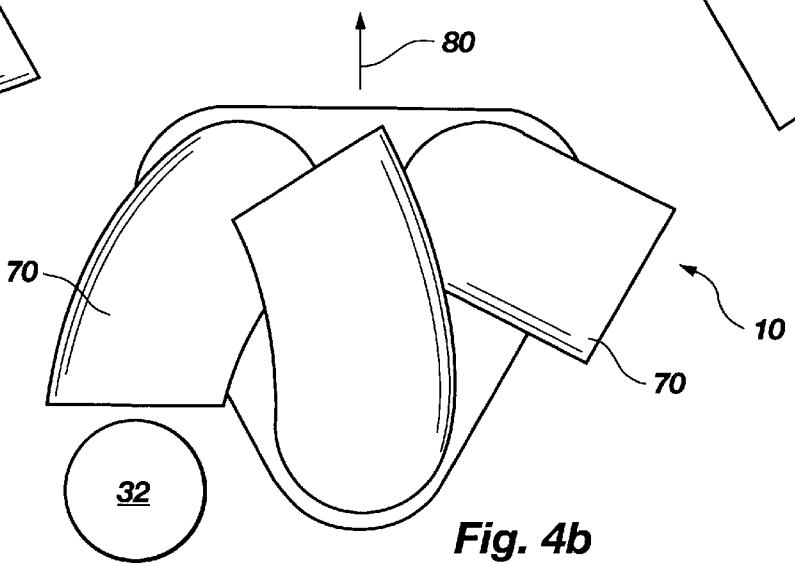
Figure 4A:
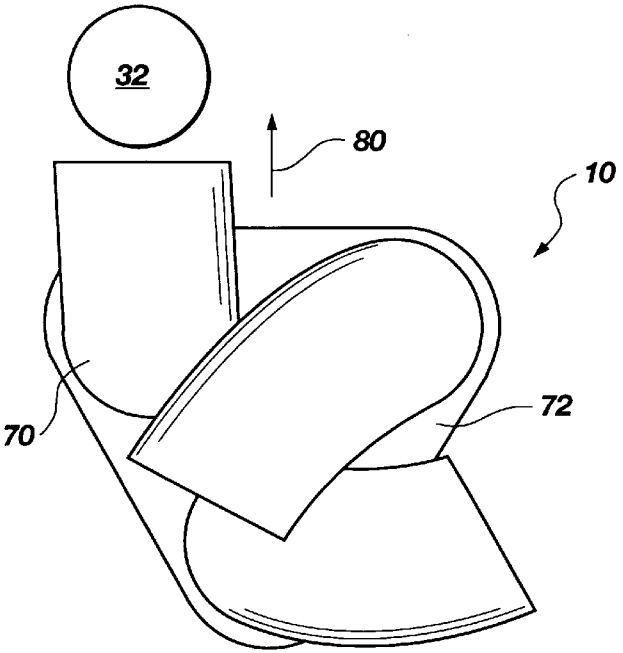

The chutes 70 are each configured to divert the product 32 to a different track as each chute is sequentially rotated under the aperture in the lower plate of the hopper. Referring to FIGS. 4*a*–4*c*, the diverter 10 is viewed from the bottom diverting product 32 in various directions as the chutes 70 are each sequentially disposed under the aperture in the lower plate by the rotating plate 72. A reference point, such as the front of the device 12, is indicated by arrow 80. Each chute 70 has a different configuration and/or orientation to divert the product 32 in a different direction as it is aligned with the lower plate aperture by the rotating plate 72. One chute 70 diverts the product 32 towards the front of the device, as shown in FIG. 4*a*. Another chute 70 diverts the product towards the rear of the device, as shown in FIG. 4*b*. Another chute 70 diverts the product 32 towards the side of the device, as shown in FIG. 4*c*.

The diverter 10 may be hiddenly disposed in the base 14 so that it cannot be seen from outside the device 12. In this way, the user does not know which track or path the product will take, adding an element of surprise to the entertainment as indicated above. Alternatively, the device 10 may be disposed in the base 14 so that it is visible from outside the device 12. For example, the diverter 10 may be located in the display section 68 of the device with the tracks 60 so that it can be seen. Even when the diverter is visible, it is still difficult to determine which path the product will take because of the configuration of the chutes and their rotation. In other words, it is difficult to ascertain which track will line up with the chute when the chute is rotated.

The diverter 10 of the present invention provides a significant advantage over prior art bulk vendors. Not only do the multiple tracks create multiple entertainment events requiring multiple activations, but the diverter creates an element of surprise, or an unknown aspect, to the device, which entices people to use the device. People not only see the multiple tracks, but guess at which path their gumball, or other product, will take.

Various other elements may be added to the device to complete the entertaining element and attract potential customers. For example, lights may be disposed in the base and oriented to shine on various components, such as the track. As another example, a speaker and electronics may be disposed in the base for producing sound, such as carnival music. Various sized bars may be arranged in a step configuration to create a xylophone type device which emits sound as a gumball falls downs the steps, striking each bar in turn. As a further example, the device and the background behind the display section of the device may be provided with appealing graphics and colors. The graphics may be drawn towards a theme, such as the circus, and incorporate the tracks, which may be configured as a merry-go-round or Ferris-wheel. The lights and sound may operate continually to draw people to the device. Alternatively, the lights and sound may be inactive until the device is used.

It is to be understood that the described embodiments of the invention are illustrative only, and that modifications thereof may occur to those skilled in the art. For example, the tracks may terminate at different points and each have a separate dispenser, rather than terminating at a common point and sharing a common dispenser. Accordingly, this invention is not to be regarded as limited to the embodiments disclosed, but is to be limited only as defined by the appended claims herein.

What is claimed is:

1. A bulk vending amusement device for dispensing a product, the device comprising;

a base;

a dispenser disposed in the base for dispensing the product for retrieval by a user;

a bin coupled to the base for holding the product in storage prior to use;

a plurality of tracks disposed in the base, each track extending substantially between the bin and the dispenser, and each track defining a different product movement path extending from the bin to the dispenser; and a diverter means disposed between the bin and the plurality of tracks and including a plurality of movable chutes for selectively diverting the product to one of the plurality of tracks.

2. The device of claim 1, wherein the diverter means comprises:

a plurality of chutes attached to a rotatable plate such that each chute is sequentially positioned between the bin and one of the plurality of tracks, each chute configured for diverting the product to a different track as the plate rotates.

3. The device of claim 1, further comprising a display portion formed in the base for viewing at least a portion of the plurality of tracks.

4. The device of claim 1, wherein the diverter means is visibly disposed in the base.

5. The device of claim 1, wherein the diverter means is at least partially concealed in the base.

6. The device of claim 1, wherein the product dispensed by the device includes gum balls.

7. The device of claim 1, wherein each of the plurality of tracks has a first end disposed near the bin and a second end disposed at the dispenser; and wherein the diverter means is disposed at the first ends of the plurality of tracks.

8. The device of claim 1, further comprising:

a hopper disposed under the bin and having an aperture through which the product passes to be dispensed; and wherein each of the plurality of tracks extends substantially between the aperture of the hopper and the dispenser.

9. The device of claim 1, wherein the diverter means comprises a plurality of chutes configured for being sequentially located under the bin, each chute being configured to divert the product in a different direction when located under the bin.

10. A bulk vending amusement device for dispensing a product, the device comprising:

a base member configured for positioning on a support surface;

a bin disposed on the base member for holding the product storage;

a dispenser disposed in the base member for dispensing the product to enable a user to retrieve the product;

a hopper disposed under the bin and having a base plate with an aperture through which the product is released, an upper plate disposed above the aperture for preventing the product from passing directly from the bin to the aperture, a rotatable disk disposed between the base plate and upper plate and having a plurality of holes formed in the rotatable disk such that the plurality of holes sequentially align with the aperture as the disk rotates for separating the product;

a crank mechanism operatively coupled to the hopper for rotating the disk so that each of the plurality of holes sequentially align with the aperture;

a plurality of tracks disposed in the base member, each track substantially extending between the hopper and the dispenser, and each track defining a different movement path for product from the hopper to the dispenser; and a diverter disposed between the hopper and the plurality of tracks and having a plurality of chutes for sequentially diverting the product from the hopper to one of the plurality of tracks.

11. The device of claim 10, wherein the diverter comprises:

a shaft operably coupled to the rotatable disk of the hopper;

a rotatable plate attached to the shaft; and a plurality of apertures formed in the plate and configured for sequentially aligning with the aperture of the base plate of the hopper; and wherein the plurality of chutes are attached to the rotatable plate under the apertures.

12. The device of claim 10, further comprising a display portion formed in the base for viewing at least a portion of the plurality of tracks.

13. The device of claim 10, wherein the diverter means is visibly disposed in the base.

14. The device of claim 10, wherein the diverter means is concealed within the base.

15. The device of claim 10, wherein the product dispensed by the device includes gum balls.

16. The device of claim 10, wherein each of the plurality of tracks has a first end disposed near the bin and a second end disposed at the dispenser; and wherein the diverter means is disposed at the first ends of the plurality of tracks.

17. The device of claim 10, wherein the plurality of chutes are configured for being sequentially located under the bin, each chute being configured to divert the product in a different direction when located under the bin.

* * * * *